US007191837B2

(12) United States Patent
Coles

(10) Patent No.: US 7,191,837 B2
(45) Date of Patent: Mar. 20, 2007

(54) MOTION COMPENSATOR

(76) Inventor: Robert A. Coles, 7419 Pacific Ridge Ct., Houston, TX (US) 77095

( * ) Notice: Subject to any disclaimer, the term of this patent is extended or adjusted under 35 U.S.C. 154(b) by 0 days.

(21) Appl. No.: 11/185,217

(22) Filed: Jul. 19, 2005

(65) Prior Publication Data

US 2006/0016605 A1 Jan. 26, 2006

Related U.S. Application Data

(60) Provisional application No. 60/589,300, filed on Jul. 20, 2004.

(51) Int. Cl.
*E21B 7/12* (2006.01)

(52) U.S. Cl. ..... 166/355; 166/350; 166/352; 166/367; 166/368

(58) Field of Classification Search ..... 166/224.2, 166/224.4, 350, 352, 355, 367, 368
See application file for complete search history.

(56) References Cited

U.S. PATENT DOCUMENTS 3,955,621 A * 5/1976 Webb ..... 166/355
4,808,035 A * 2/1989 Stanton et al. ..... 405/224.4
4,883,387 A * 11/1989 Myers et al. ..... 405/224.4
4,913,238 A * 4/1990 Danazcko et al. ..... 405/223.1
5,846,028 A * 12/1998 Thory ..... 405/195.1
6,173,781 B1 * 1/2001 Milne et al. ..... 166/355
6,530,430 B2 * 3/2003 Reynolds ..... 166/346
6,739,395 B2 * 5/2004 Reynolds ..... 166/346
6,837,311 B1 * 1/2005 Sele et al. ..... 166/353
2004/0099421 A1 * 5/2004 Trewhella ..... 166/355

OTHER PUBLICATIONS

JMC Technology Website Printout, http://www.jmc.no/technology/coiled_tubing/heave_compensators.php, 2 pages, May 31, 2005.

* cited by examiner

*Primary Examiner*—Thomas B. Will
*Assistant Examiner*—Christopher Buchanan
(74) *Attorney, Agent, or Firm*—Bracewell & Giuliani LLP

(57) ABSTRACT

A motion compensator is used on a floating vessel servicing a subsea well. The motion compensator includes a first frame assembly adapted to be connected to a cable extending from a lifting structure. When connected to the cable, the first frame assembly extends longitudinally along an axis substantially parallel with that of the cable. The motion compensator also includes a second frame assembly connected to the first frame assembly. The second frame assembly overlaps a longitudinal portion of the first frame assembly. The first and second frame assemblies are moveable relative to each other and define an expanded position and a contracted position. The motion compensator further includes a piston assembly positioned between the first and second frame assemblies. The piston assembly has a piston chamber and a piston that slidingly engages the piston chamber when the first and second rod assemblies move relative to each other.

16 Claims, 2 Drawing Sheets

MOTION COMPENSATOR

RELATED APPLICATIONS

Applicant claims priority to the application described herein through a U.S. provisional patent application titled "Motion Compensator," having U.S. Patent Application Ser. No. 60/589,300, which was filed on Jul. 20, 2004, and which is incorporated herein by reference in its entirety.

BACKGROUND OF INVENTION

1. Field of the Invention

The present invention relates generally to offshore platforms, and more specifically to an assembly for compensating for motion.

2. Background of the Invention

When servicing a subsea well from a floating vessel, tidal variations cause the vessel, as well as surface wellhead assemblies connected an upper end of a riser from the subsea well location, to drift. This phenomenon is commonly known as "tidal drift." When servicing the well through the surface wellhead assembly, the servicing equipment is typically suspended above the surface wellhead assembly. The typical servicing equipment can be the equipment commonly known and associated in the art for coiled tubing, wireline, and snubbing well intervention work. The tidal drift can cause excessive forces to be experienced on the equipment that can damage or break the servicing equipment and the surface wellhead assembly.

Conventional devices used for accommodating for such movements are large and bulky in size. These devices are so large that they cannot be used within a drilling rig. Moreover, the conventional devices are not responsive to the tidal drift. Rather, the operator has to monitor the status of the equipment in response to tidal drift, and then manually adjust the device as needed. This process can be costly and dangerous, because it is desirous to keep the line supporting the servicing equipment taught so that as little weight as possible is supported by the surface wellhead assembly.

SUMMARY OF THE INVENTION

An offshore assembly is associated with an offshore well. The offshore assembly includes a floating vessel upon which operations for a subsea well are performed. The floating vessel is responsive to tidal movements of water upon which the vessel floats. The tidal movements include the movements that are associated with tidal drift of the vessel. The offshore assembly also includes a surface wellhead assembly in fluid communication with the subsea well. The wellhead assembly is supported on a riser extending up to the surface wellhead assembly from a subsea location. The floating vessel is moveable relative to the wellhead assembly while the wellhead assembly is in communication with the subsea well. The offshore assembly further includes a lifting apparatus for lifting and supporting an interface device connecting to the wellhead assembly. The lifting apparatus has a cable extending therefrom and being positioned on the floating vessel. The lifting apparatus moves with the floating vessel. The offshore assembly also includes a motion compensator positioned between the surface wellhead assembly and the cable. The motion compensator is moveable between an expanded position and a contracted position in order to compensate for movement of the floating vessel and the lifting apparatus responsive to the tidal movement of the water.

The present invention also provides a motion compensator for use on a floating vessel servicing a subsea well. The motion compensator includes a first frame assembly adapted to be connected to a cable extending from a lifting structure. When connected to the cable, the first frame assembly extends longitudinally along an axis substantially parallel with that of the cable. The motion compensator also includes a second frame assembly connected to the first frame assembly. The second frame assembly overlaps a longitudinal portion of the first frame assembly. The first and second frame assemblies are moveable relative to each other and define an expanded position and a contracted position. The motion compensator further includes a piston assembly positioned between the first and second frame assemblies. The piston assembly has a piston chamber and a piston that slidingly engages the piston chamber when the first and second rod assemblies move relative to each other.

In one version of motion compensator for use on a floating vessel servicing a subsea well, the motion compensator includes a first frame assembly adapted to be connected to a cable extending from a lifting structure. The first frame assembly extends longitudinally along an axis substantially parallel with that of the cable when connected. The first frame assembly has a first end plate and a first medial plate that are fixedly connected to each other by a plurality of first rods. The motion compensator also includes a second frame assembly connected to the first frame assembly such that the second frame assembly overlaps a longitudinal portion of the first frame assembly. The second frame assembly has a second end plate and a second medial plate that are fixedly connected to each other by a plurality of second rods. The first and second frame assemblies being moveable relative to each other to define an expanded position and a contracted position. The motion compensator further includes a piston assembly positioned between the first and second frame assemblies. The piston assembly has a piston chamber and a piston that slidingly engages the piston chamber when the first and second rod assemblies move relative to each other.

Each of the plurality of second rods preferably extend through and slidingly engage the first medial plate when the motion compensator moves between the expanded and contracted positions. Each of the plurality of first rods also preferably extend through and slidingly engage the second medial plate when the motion compensator moves between the expanded and contracted positions.

DETAILED DESCRIPTION OF THE PREFERRED EMBODIMENTS

Figure 1:
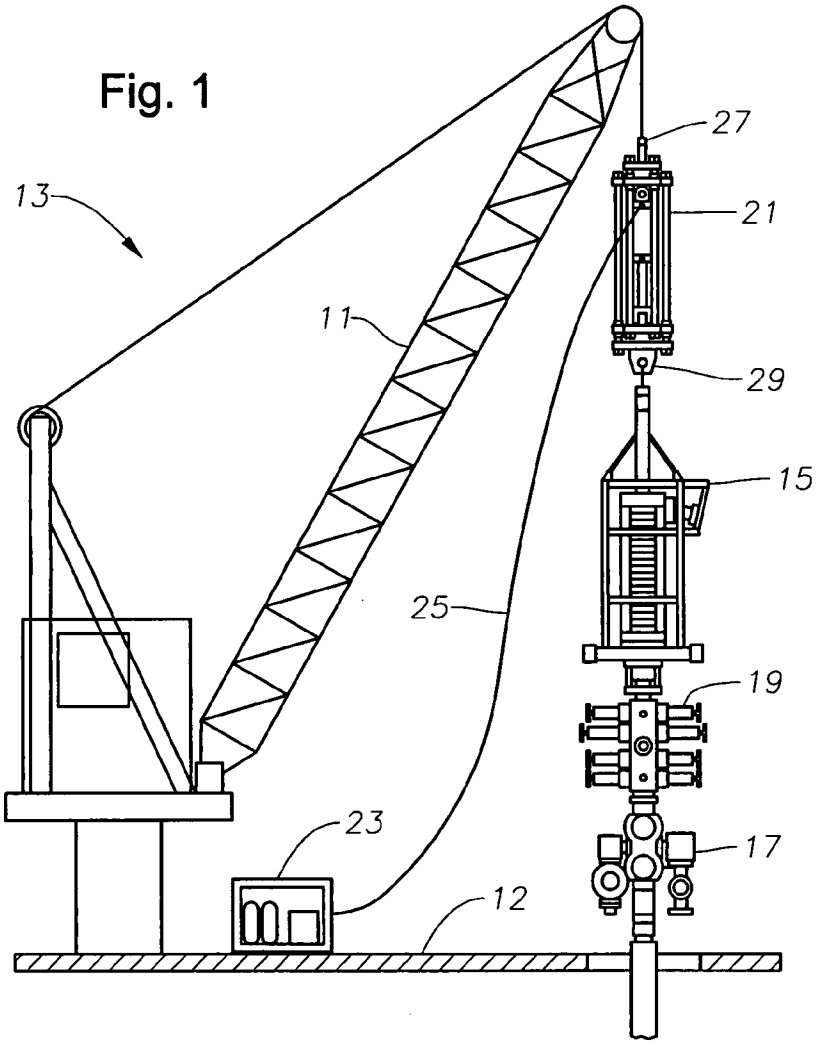
FIG. 1 is a schematic view of a floating offshore platform assembly for performing intervention on a well, which is constructed in accordance with the present invention.

Referring to FIG. 1, a crane 11 is shown on top of a platform 13. Platform 13 is typically a platform associated with an offshore facility for oil wells. A surface wellhead assembly 17 rests atop of a distal end of casing that extends through a deck 12 of the platform to a subsea well (not shown) positioned below platform 13. A coiled tubing injector 15 is suspended from crane 11 for connection with wellhead 17. Coiled tubing injector 15 can be used in a manner known in the art for injecting coiled tubing in order to perform intervention on the well. A coiled tubing blowout preventer system 19 is preferably located between coiled tubing injector 15 and wellhead 17 in order to control possible blowouts from a well during operations.

A motion compensator 21 is also suspended from crane 11 in a position above coiled tubing injector 15. Motion compensator 21 advantageously compensates for motions of platform 13 relative to wellhead 17 due to tidal variations of the water below. A hydraulic power pack 23 is located on platform 13 for supplying hydraulic fluid and power to motion compensator 21. Hydraulic power pack 23 also controls the hydraulic fluid injected and removed from motion compensator 21. A hydraulic control hose 25 extends from hydraulic power pack 23 to motion compensator 21 suspended from crane 11 for the transfer of hydraulic fluid between hydraulic power pack 23 and motion compensator 21. An upper connector 27 connects motion compensator 21 to a cable extending from crane 11, while a lower connector 29 connects motion compensator 21 to a cable extending to coiled tubing injector 15.

Figure 2:
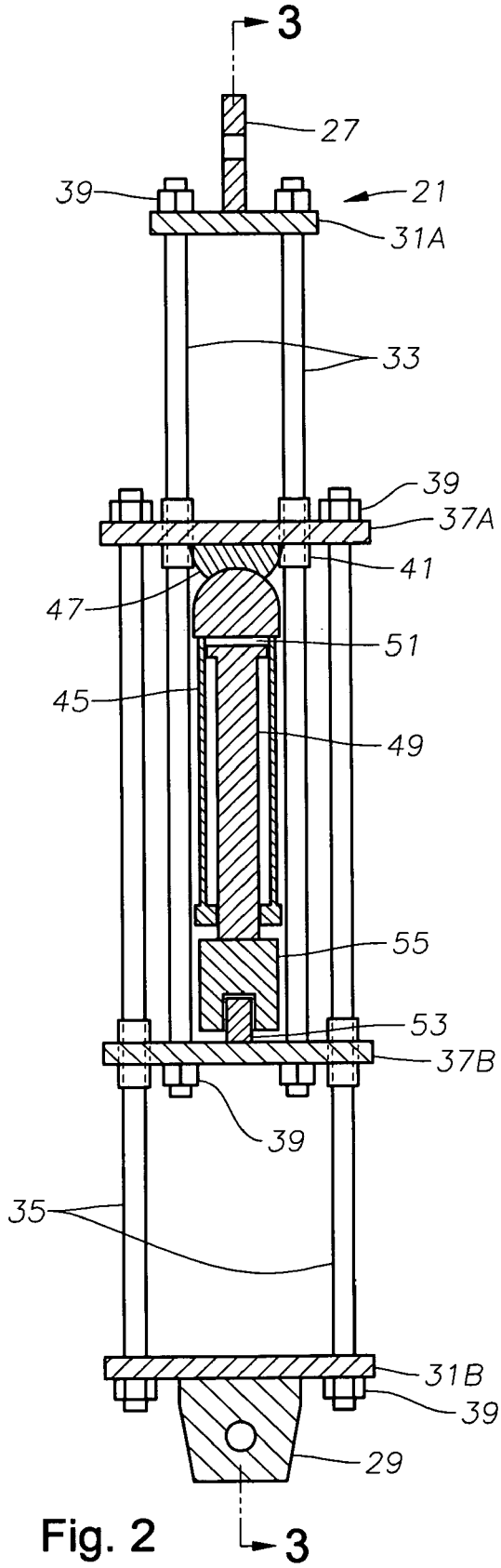
FIG. 2 is a sectional view of the motion compensator shown in FIG. 1 while in its extended position.
Figure 3:
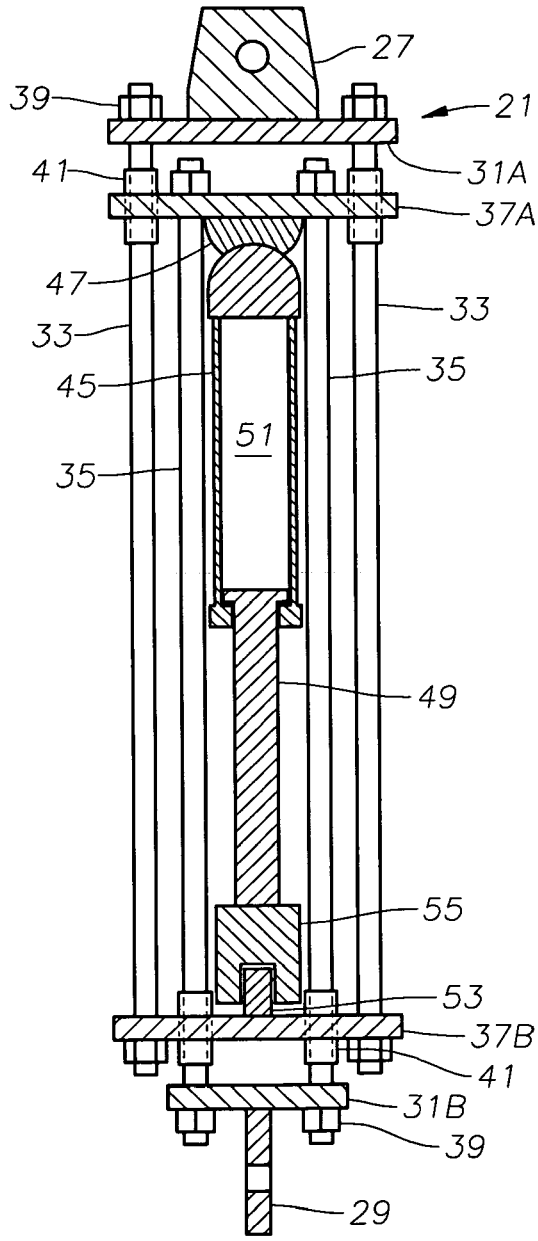
FIG. 3 is a sectional view of the motion compensator, taken along line 3—3 shown in FIG. 2 while in its compressed position.

Referring to FIGS. 2 and 3, motion compensator 21 preferably includes end plates 31 connected to upper connector and lower connector 27, 29. For ease of reference, end plate 31 connected to upper connector 27 is upper end plate 31A, and end plate 31 connected to lower connector 29 is lower connector 31B. A plurality of upper guide rods 33 extend downward from end plate 31A, and a plurality of lower guide rods 35 extend upward from end plate 31B. A plurality of middle plates 37 are positioned between end plates 31A, 31B. An upper middle plate 37A is positioned adjacent upper end plate 31A. Likewise, a lower middle plate 37B is positioned adjacent lower end plate 31B. Upper guide rods 33 extend downward through upper middle plate 37A and connect to lower middle plate 37B. Upper guide rods 35 extend upward from end plate 31B through middle plate 37B and connect to middle plate 37A. Fasteners 39 connect to ends of upper and lower guide rods 33, 35 in order to hold upper and lower guide rods 33, 35 relative to end plates 31A, 31B and middle plates 37A, 37B. A guide sleeve 41 is positioned around each upper and lower guide rod 33, 35 extending through middle plates 37. In the preferred embodiment, guide sleeves 41 allow upper and lower guide rods 33, 35 to slide relative the middle plates 37A, 37B that upper and lower guide rods 33, 35 are passing through. In the preferred embodiment, a plurality of openings 43 (FIGS. 4 and 5) allow upper and lower guide rods 33, 35 to pass through middle plates 37A, 37B and end plates 31A, 31B.

Figure 4:
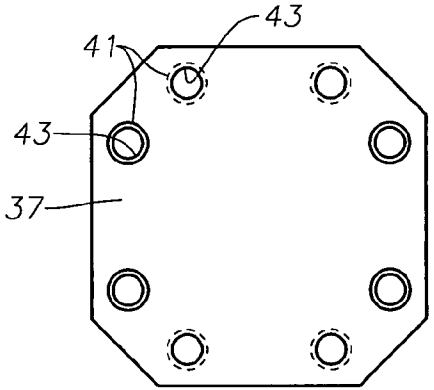
FIG. 4 is a middle plate of the motion compensator shown in FIG. 2.
Figure 5:
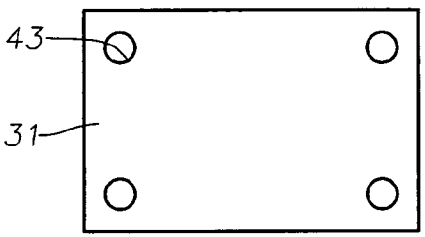
FIG. 5 is an end plate of the motion compensator shown in FIG. 2.

Referring to FIGS. 4 and 5, middle plates 37 are preferably octagonal or square shaped, while end plates 31 are preferably rectangular in shape. End plates 31 preferably include openings 43 located adjacent each of the corners of rectangular shaped end plate 31. End plates 31 are preferably offset by 90 degrees so that end plate 31A extends in a direction generally perpendicular to the direction that end plate 31B extends. The result of the 90 degree offset is best shown in FIGS. 2 and 3 wherein connector plate 31A connected to upper connector 27 is shown along its narrow side in FIG. 2 and along its wider side in FIG. 3. Connector plate 31B connected to lower connector 29 however is shown in FIG. 2 along its wider side and along its narrow side in FIG. 3. Due to this configuration in FIG. 2 upper connector rods 33 are shown within lower connector rods 35 in FIG. 2 but are shown outside of lower connector rods 35 in FIG. 3 when viewed from a different direction.

Motion compensator 21 preferably includes a piston housing 45 located between middle plates 37. Piston housing 45 is preferably connected to middle plate 37A by upper piston support 47. A piston 49 ends from lower middle plate 37B into piston housing 45. Piston housing 45 and piston 49 define a piston chamber 51 that changes in size as piston 49 strokes within piston chamber 45. As shown in FIG. 2, piston 45 is fully stroked to its compressed state. However, piston 49 is stroked to its expanded state in FIG. 3. A bracket 53 extends from lower middle plate 37B and connects to a piston connector 55. Piston 49 is fixedly connected to lower middle plate 37B via piston connector 55 and bracket 53. Therefore, as upper and lower middle plates 37A, 37B move relative to each other piston 49 strokes relative to piston housing 45.

In operation, upper connector 27 connects to a cable suspended from crane 11 located on platform 13. Lower connector 29 connects to a cable extending below and connecting to coiled tubing injector 15 which in turn supports coiled tubing blowout preventers 19 and wellhead 17. Typically, coiled tubing is rigid in an axial direction such that the coiled tubing does not compress or lengthen due to upward and downward movement of platform 13. Therefore, any upward and downward movement of platform 13 relative to the sea floor is transferred through coiled tubing injector 15 to motion compensator 21.

Any upward movements of platform 13 relative to the sea floor, causes end plates 31 on motion compensator 21 to separate to the position shown in FIG. 2. Increasing the distance between end plates 31A, 31B causes lower guide rods 35 to pull downward against upper middle plate 37A and upper guide rods 33 to pull upward on lower middle plate 37B. Accordingly, the separation of end plates 31A, 31B causes upper and lower middle plates 37A, 37B to compress toward each other, which in turn causes piston 49 to stroke inward relative to piston housing 45. Any hydraulic fluid, which can be oil and/or nitrogen gas located within chamber 51, provides resistance to piston 49 stroking within piston chamber 45. As piston 49 strokes inward and compresses piston chamber 51, hydraulic fluid is transferred out of piston chamber 45 through control hose 25 to hydraulic power pack 23. Hydraulic power pack 23 stores the hydraulic fluid for injection into chamber 51 when piston 49 strokes axially downward to its extended state shown in FIG. 3. Hydraulic power pack 23 preferably also includes an accumulator system for storing hydraulic energy from the hydraulic fluid. In the preferred embodiment, hydraulic power pack 23 also dampens shock forces experienced through motion compensator 21.

When the tides of the sea cause platform 13 to lower relative to sea floor, the cable from crane 11 and between motion compensator 21 will no longer be in tension. Hydraulic power pack 23 preferably supplies hydraulic fluid into piston chamber 51 via hydraulic control hose 25 in order to stroke piston 49 to its extended state as shown in FIG. 3. Forcing piston 49 to its extended state by injecting the hydraulic fluid within piston chamber 45 pushes upper and lower middle plates 37A, 37B apart. By separating upper and lower middle plates 37A, 37B, upper and lower guide rods 33, 35 pull end plates 31A, 31B toward each other. By decreasing the distance between end plates 31A, 31B, the tension between crane 11 and coiled tubing blowout preventers 19 is maintained even while platform 13 has lowered relative to the sea floor.

Motion compensator 21 is small enough to be suspended from a variety of lifting devices 11. FIG. 1 illustrates a crane, but lifting device 11 for suspending motion compensator 21 can also be a derrick, an A-frame or another temporary support assembly. Motion compensator 21 helps to automatically respond to tidal variations in order to keep cable 27 taught so that as little weight of the servicing equipment as possible is transferred or carried by surface wellhead assembly 17.

While the invention has been shown in only one of its forms, it should be apparent to those skilled in the art that it is not so limited, but is susceptible to various changes without departing from the scope of the invention. For example, middle and end plates 37, 31 can be designed with different geometries than shown in FIGS. 4 and 5 while performing substantially the same functions. Moreover, while the invention has only been shown and described for use with coiled tubing, motion compensator 21 can also be useful for invention during utilizing wireline, electric-line, and snubbing operations.

The invention claimed is:

1. An offshore assembly for performing operations on an offshore well, comprising:

a floating vessel;

an interface device for mounting to a wellhead assembly of an offshore well;

a lifting apparatus for lifting the interface device over the wellhead assembly and supporting the interface device while the interface device is in enaagement with the wellhead assembly, the lifting apparatus having a cable with a terminal end extending therefrom, the lifting apparatus being positioned on the floating vessel for movement therewith;

a motion compensator connected between the interface device and the terminal end of the cable, the motion compensator being moveable between an expanded position and a contracted position in order to compensate for movement of the floating vessel and the lifting apparatus responsive to the movement of the water; wherein the motion compensator comprises:

a first frame assembly comprising a first plurality of rods extending substantially parallel to each other, a first end plate fixedly connected to an end portion of each of the first plurality of rods, and a first medial plate fixedly connected to the opposite end portion of each of the first plurality of rods;

a second frame assembly comprising a second plurality of rods extending substantially parallel to each other, a second end plate fixedly connected to an end portion of each of the second plurality of rods, and a second medial plate fixedly connected to the opposite end portion of each of the second plurality of rods, the second frame assembly overlapping the first frame assembly such that the first medial plate is positioned between the second end plate and the second medial plate and the second medial plate is positioned between the first medial plate and the first end plate, the first and second frame assemblies being movable relative to each other between the expanded and the contracted positions; and a piston and chamber connected between the medial plates of the first and second frame assemblies for reducing changes in tension in the cable responsive to the movement of the floating vessel and the lifting apparatus relative to the wellhead assembly, the piston and chamber contracting when the first and second frame assemblies move toward the expanded position.

2. The offshore assembly of claim 1 further comprising a blow out preventer for positioning between the wellhead assembly and the interface device.

3. The offshore assembly of claim 1, wherein the interface device is a coiled tubing injector.

4. The offshore assembly of claim 1, wherein the motion compensator further comprises:

a hydraulic power pack positioned on the floating vessel that is in fluid communication with the chamber, the hydraulic power pack having an accumulator for hydraulic fluid and a control system for automatically supplying to and releasing hydraulic fluid from the piston and chamber responsive to the movement of the floating vessel and the lifting apparatus.

5. The offshore assembly of claim 1, wherein:

the first frame assembly has a fixed length from the first end plate to the first medial plate; and the second frame assembly has a fixed length from the second end plate to the second medial plate.

6. A motion compensator for use with an interface device on a floating vessel servicing a subsea well, comprising:

a first frame assembly adapted to be connected to a lifting device, the first frame assembly extending longitudinally along an axis and having a first end plate and a first medial plate;

a second frame assembly adapted to be connected to an interface device, the second frame assembly having a second end plate and a second medial plate, the second frame assembly being connected to the first frame assembly such that the second medial plate is located between the first end plate and the first medial plate, the first and second frame assemblies defining a guideframe, and the first and second frame assemblies being moveable relative to each other along the longitudinal axis to define an expanded position and a contracted position of the guideframe;

a piston assembly positioned between the first and second medial plates, the piston assembly comprising a piston chamber and a piston such that the piston slidingly engages the piston chamber when the first and second frame assemblies move relative to each other, the piston assembly extending when the first and second frame assemblies move toward the contracted position; and an accumulator for supplying fluid to and relieving fluid from the piston chamber when the first and second frame assemblies move relative to each other to reduce changes in tension imposed on the lifting device.

7. The motion compensator of claim 6, wherein each of the first and second frame assemblies comprise: a plurality of rods extending substantially parallel to each other, one of the end plates fixedly connected to an end portion of each of the plurality of rods; and one of the medial plates fixedly connected to the opposite end portion of each of the plurality of rods; and wherein the rods of the first frame assembly slidingly engage the second medial plate, and the rods of the second frame assembly slidingly engage the first medial plate when the first and second frame assemblies move relative to each other.

8. The motion compensator of claim 7, wherein the ends of each of the plurality of rods extend through one of the end plates and one of the medial plates and engage a fastening device for fixedly connecting each of the plurality of rods to one of the end plates and one of the medial plates.

9. The motion compensator of claim 6, wherein the length of the first frame assembly between the first end plate and first medial plate is fixed, and the length of the second frame assembly between the second end plate and the second medial plate is fixed.

10. The motion compensator of claim 7, the first medial plate has openings for slidingly receiving each of the plurality of rods of the second frame assembly, and the second medial plate has openings for slidingly receiving each of the plurality of rods of the first frame assembly.

11. The motion compensator of claim 6, wherein length of stroke of the guideframe between the contracted and the expanded positions is twice a length of stroke of the piston and piston chamber.

12. The motion compensator of claim 6, wherein:

the first frame assembly comprises a plurality of parallel, fixed length first rods connected between the first end plate and the first medial plate;

the second frame assembly comprises a plurality of parallel, fixed length second rods connected between the second end plate and the second medial plate;

the first rods extending slidably through bushings in the second medial plate; and the second rods extending slidably through bushings in the first medial plate.

13. The motion compensator of claim 6, wherein the first and second frame assemblies are rotationally offset from each other such that the second end plate of the second frame assembly is substantially 90 degrees offset from the first end plate of the first frame assembly.

14. The motion compensator of claim 7, wherein the end plates of the first and second frame assemblies have openings equal to the number of each of the respective plurality of rods for first and second frame assemblies so the end plates only receive rods from each of their respective frame assemblies;

the medial plates of the first and second frame assemblies have openings equal to the total number of the plurality of rods of both the first and second frame assemblies so that the medial plates receive each of the plurality of rods of both the first and second frame assemblies.

15. A motion compensator for use with an interface device on a floating vessel servicing a subsea well, comprising:

a first frame assembly adapted to be lifted by a lifting structure, the first frame assembly having a first end plate and a first medial plate that are fixedly connected to each other by a plurality of parallel, fixed length, first rods;

a second frame assembly connected to the first frame assembly such that the second frame assembly overlaps a longitudinal portion of the first frame assembly with the second frame assembly being adapted to connect to an interface device, the second frame assembly having a second end plate and a second medial plate that are fixedly connected to each other by a plurality of parallel, fixed length second rods, the first and second frame assemblies defining a guideframe, the first medial plate being located between the second end plate and the second medial plate, the second medial plate being located between the first end plate and the first medial plate, the first and second frame assemblies being moveable relative to each other to define an expanded position and a contracted position of the guideframe, and while moving from the contracted position to the expanded position, the medial plates move closer to each other and the end plates move farther from each other;

a piston assembly positioned between the first and second frame assemblies, the piston assembly comprising a piston chamber and a piston connected between the first and second medial plates; and an accumulator for supplying fluid pressure to the piston chamber.

16. The motion compensator of claim 15, wherein each of the plurality of second rods extend through and slidingly engage the first medial plate when the motion compensator moves between the expanded and contracted positions, and each of the plurality of first rods extend through and slidingly engage the second medial plate when the motion compensator moves between the expanded and contracted positions.

* * * * *